US009186778B2

(12) United States Patent
Huang

(10) Patent No.: US 9,186,778 B2
(45) Date of Patent: Nov. 17, 2015

(54) SIMPLE OPEN-END WRENCH

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 378 days.

(21) Appl. No.: 13/758,052

(22) Filed: Feb. 4, 2013

(65) Prior Publication Data

US 2014/0116207 A1 May 1, 2014

(30) Foreign Application Priority Data

Oct. 26, 2012 (TW) ..... 101139701 A

(51) Int. Cl.
*B25B 13/08* (2006.01)
*B25B 13/46* (2006.01)

(52) U.S. Cl.
CPC ..... *B25B 13/08* (2013.01); *B25B 13/46* (2013.01)

(58) Field of Classification Search
CPC ..... B25B 13/08; B25B 13/46; B25B 13/28; B25B 13/36
See application file for complete search history.

(56) References Cited

U.S. PATENT DOCUMENTS

| | | | | |
|---|---|---|---|---|
| 1,661,229 | A * | 3/1928 | Montgomery | 81/92 |
| 1,898,388 | A * | 2/1933 | Parker | 81/179 |
| 2,447,835 | A * | 8/1948 | Beard | 81/92 |
| 2,514,687 | A * | 7/1950 | Eugene | 81/111 |
| 2,602,362 | A * | 7/1952 | Johns | 81/92 |
| 2,700,315 | A | 1/1955 | Hermanson | |
| 2,805,593 | A * | 9/1957 | Darrow | 81/97 |
| 3,161,091 | A * | 12/1964 | Searcy | 81/62 |
| 3,641,847 | A * | 2/1972 | Horton | 81/111 |
| 7,010,999 | B1 * | 3/2006 | Wu | 81/170 |
| 7,077,035 | B1 * | 7/2006 | Huang | 81/179 |
| 7,188,551 | B2 * | 3/2007 | Choi | 81/98 |
| 7,878,095 | B2 * | 2/2011 | Wu | 81/179 |
| 8,261,640 | B2 * | 9/2012 | Wu | 81/186 |
| 8,342,059 | B2 | 1/2013 | Hu | |
| 8,516,929 | B2 * | 8/2013 | Huang | 81/90.1 |
| 8,573,095 | B2 * | 11/2013 | Hu | 81/179 |
| 8,826,783 | B2 * | 9/2014 | Hu | 81/179 |
| 8,904,908 | B1 * | 12/2014 | Luhman | 81/92 |
| 2010/0269640 | A1 * | 10/2010 | Robinson | 81/59.1 |
| 2011/0000343 | A1 * | 1/2011 | Nam | 81/90.3 |

FOREIGN PATENT DOCUMENTS

| | | | |
|---|---|---|---|
| CN | 2107355 | U | 6/1992 |
| TW | 200902240 | A | 1/2009 |
| TW | M382177 | U | 6/2010 |
| TW | M384740 | U | 7/2010 |
| TW | 201236823 | A | 9/2012 |
| TW | M451213 | U | 4/2013 |
| WO | WO02074498 | A1 | 9/2002 |

* cited by examiner

*Primary Examiner* — David B Thomas
(74) *Attorney, Agent, or Firm* — Alan D. Kamrath; Kamrath IP Lawfirm, P.A.

(57) ABSTRACT

A simple open-end wrench includes a driving head including first and second jaws, a space delimited between the first and second jaws, first and second recesses extended from the space, a pawl pivotally embedded in the first recess, and a biasing mechanism received in the second recess and abutted against the pawl. The pawl includes an abutting end disposed outside the second recess and extended into the space. The pawl is pivotal to a position with the abutting end thereof disposed within the second recess.

19 Claims, 22 Drawing Sheets

SIMPLE OPEN-END WRENCH

BACKGROUND OF THE INVENTION

1. Field of the Invention

The present invention relates to an open-end wrench and, in particular, to an open-end wrench including a ratchet mechanism.

2. Description of the Related Art

U.S. Pat. No. 2,700,315, entitled open-end ratchet wrench, shows a wrench including a head with a slot. Two dogs are respectively disposed at two sides of the slot. Each dog is pivotally engaged in a recess with a pivot and is pivotal relative to the head. Each dog is subject to a biasing force of a spring, which facilitates the dog to return to its original position. A shaft is used to fix each spring. However, each dog does not have a strong structure, because it is made with a through hole for pivot. A larger shear force can cause the pivot to break, because the pivot is limited to have a relatively small cross-sectional area. Therefore, the ratchet wrench can't withstand a large torque transmission well. The present invention is, therefore, intended to obviate or at least alleviate the problems encountered in the prior art, as well as to make a simple and cost-saving wrench.

SUMMARY OF THE INVENTION

According to the present invention, a simple open-end wrench includes a driving head including first and second jaws, a space delimited between the first and second jaws for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl. The pawl includes the abutting end disposed outside the second recess and extended into the space. The pawl is pivotal to a position with the abutting end thereof disposed within the second recess.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a ratchet wrench which better withstands torque transmission and is capable of being operated through a relatively smaller minimum swing angle action.

Other objectives, advantages, and new features of the present invention will become apparent from the following detailed description of the invention when considered in conjunction with the accompanied drawings.

DETAILED DESCRIPTION OF THE INVENTION

Figure 1:
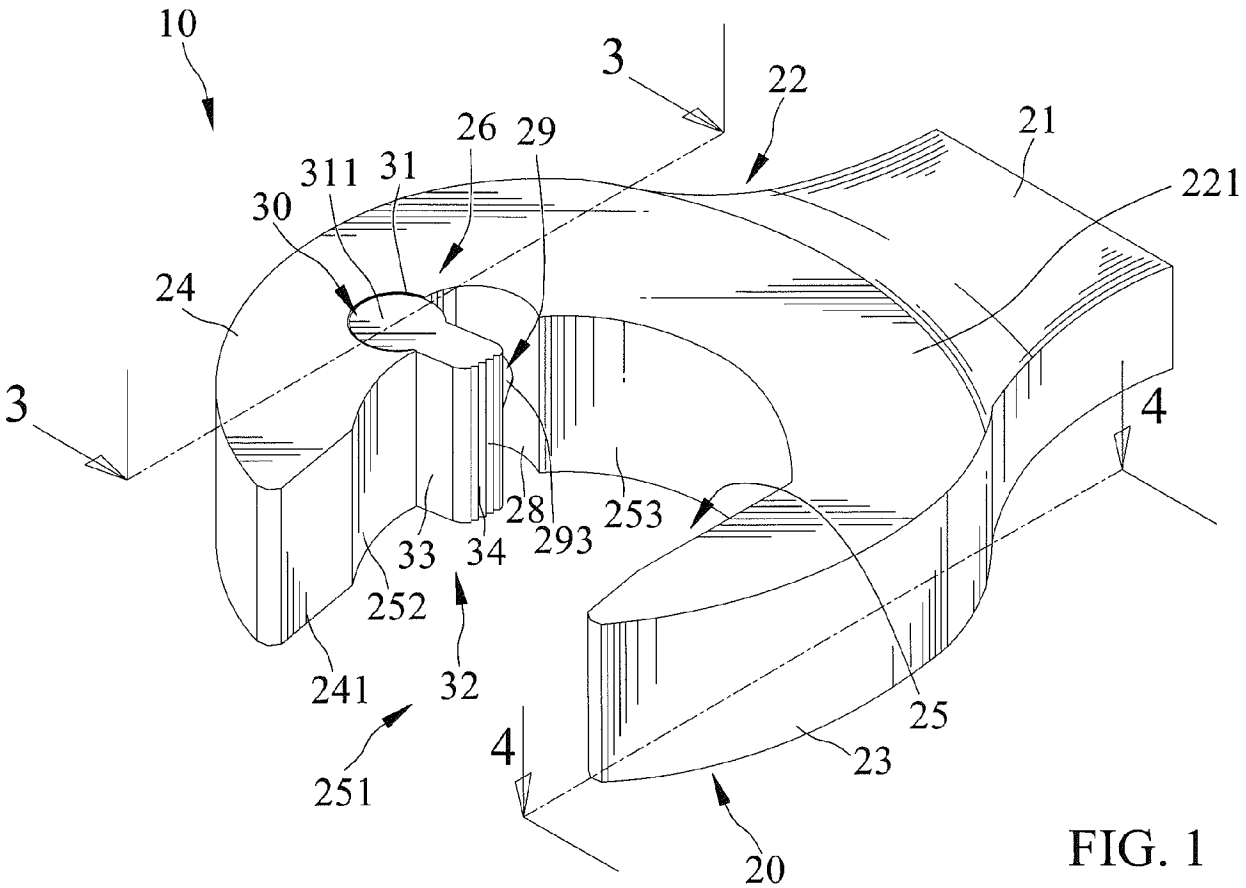
FIG. 1 is a perspective view of a driving head of a simple open-end wrench in accordance with a first embodiment of the present invention.
Figure 2:
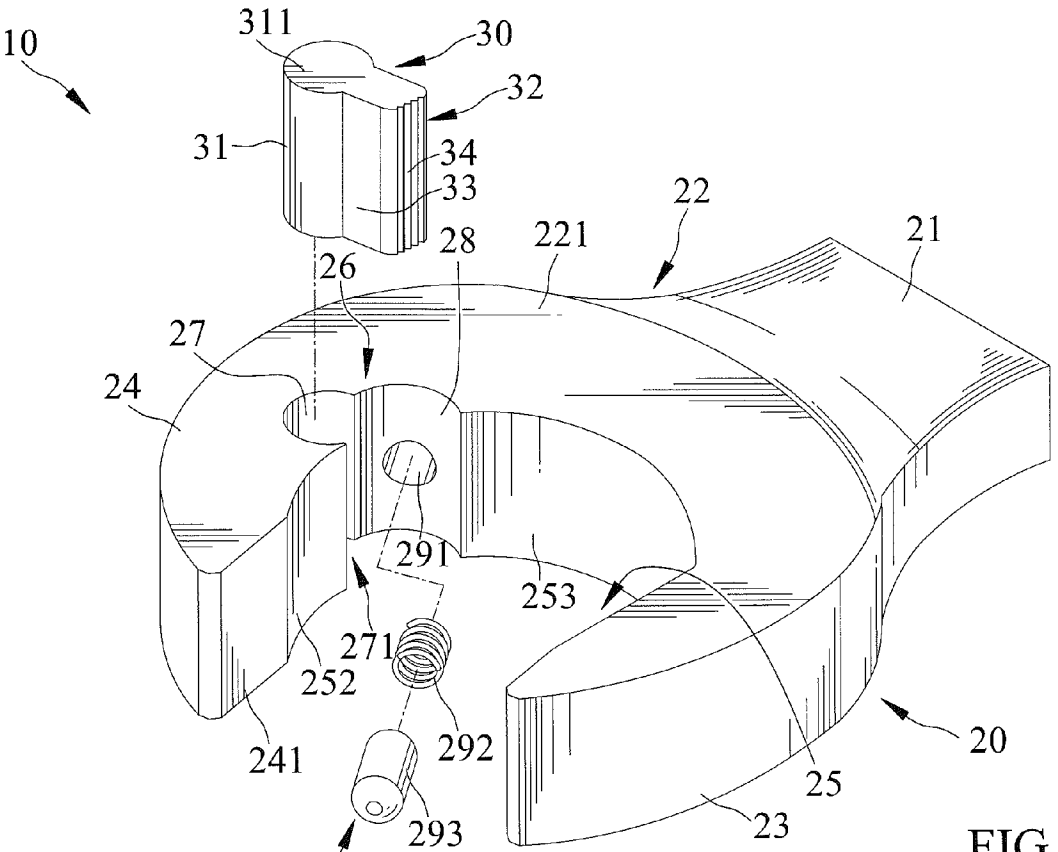
FIG. 2 is an exploded perspective view of FIG. 1.
Figure 3:
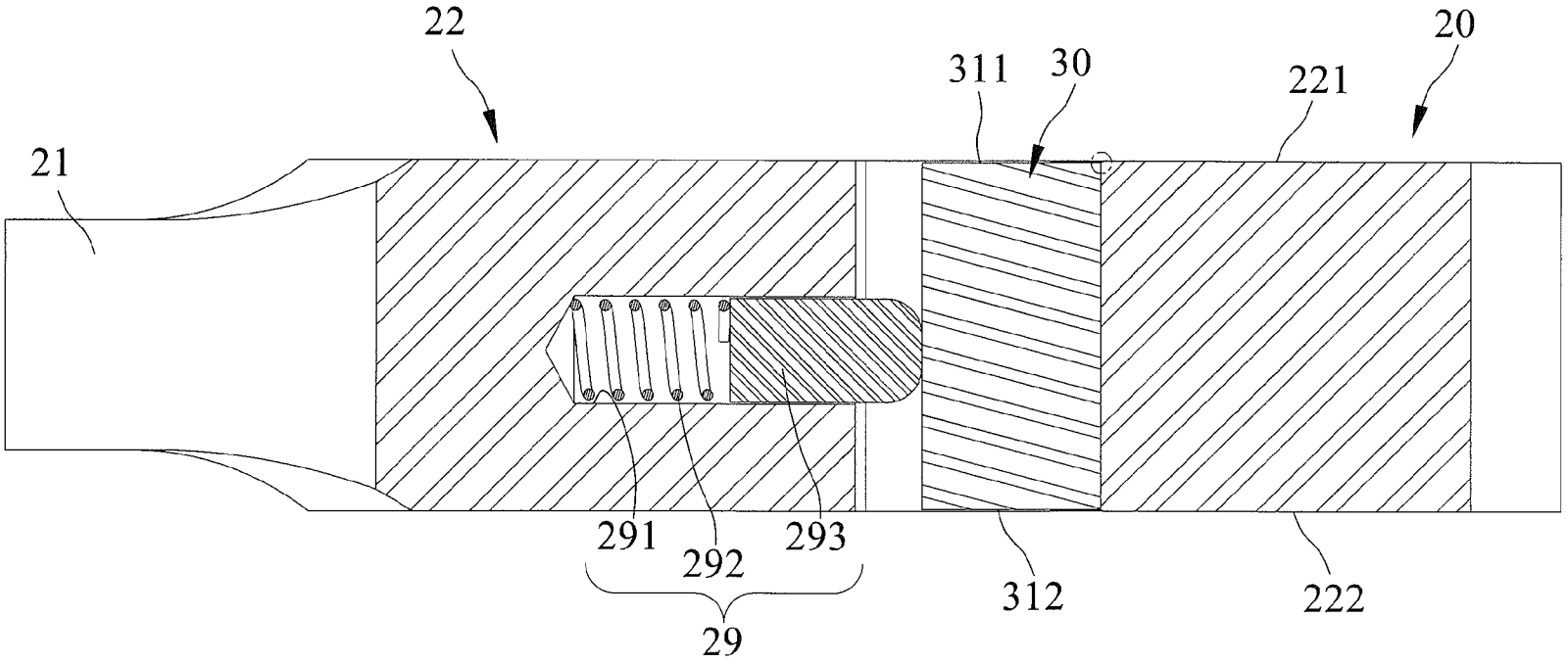
FIG. 3 is a cross-sectional view of FIG. 1.
Figure 3A:
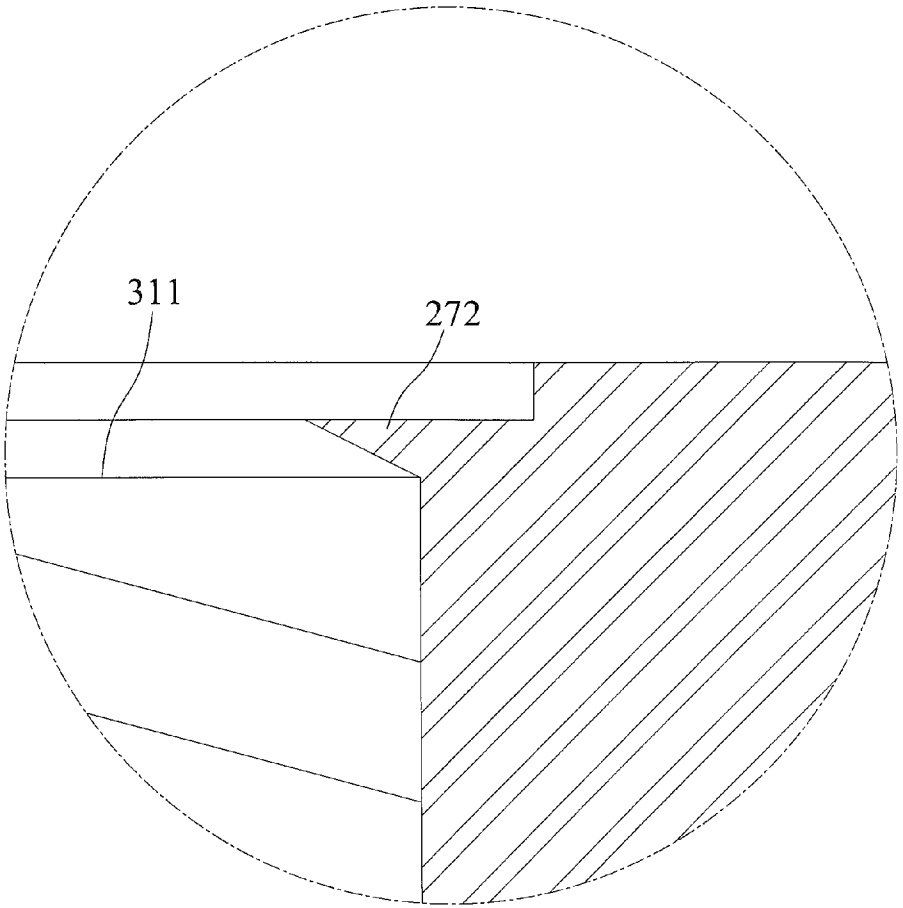
FIG. 3A is a partial, enlarged view of FIG. 3.
Figure 4:
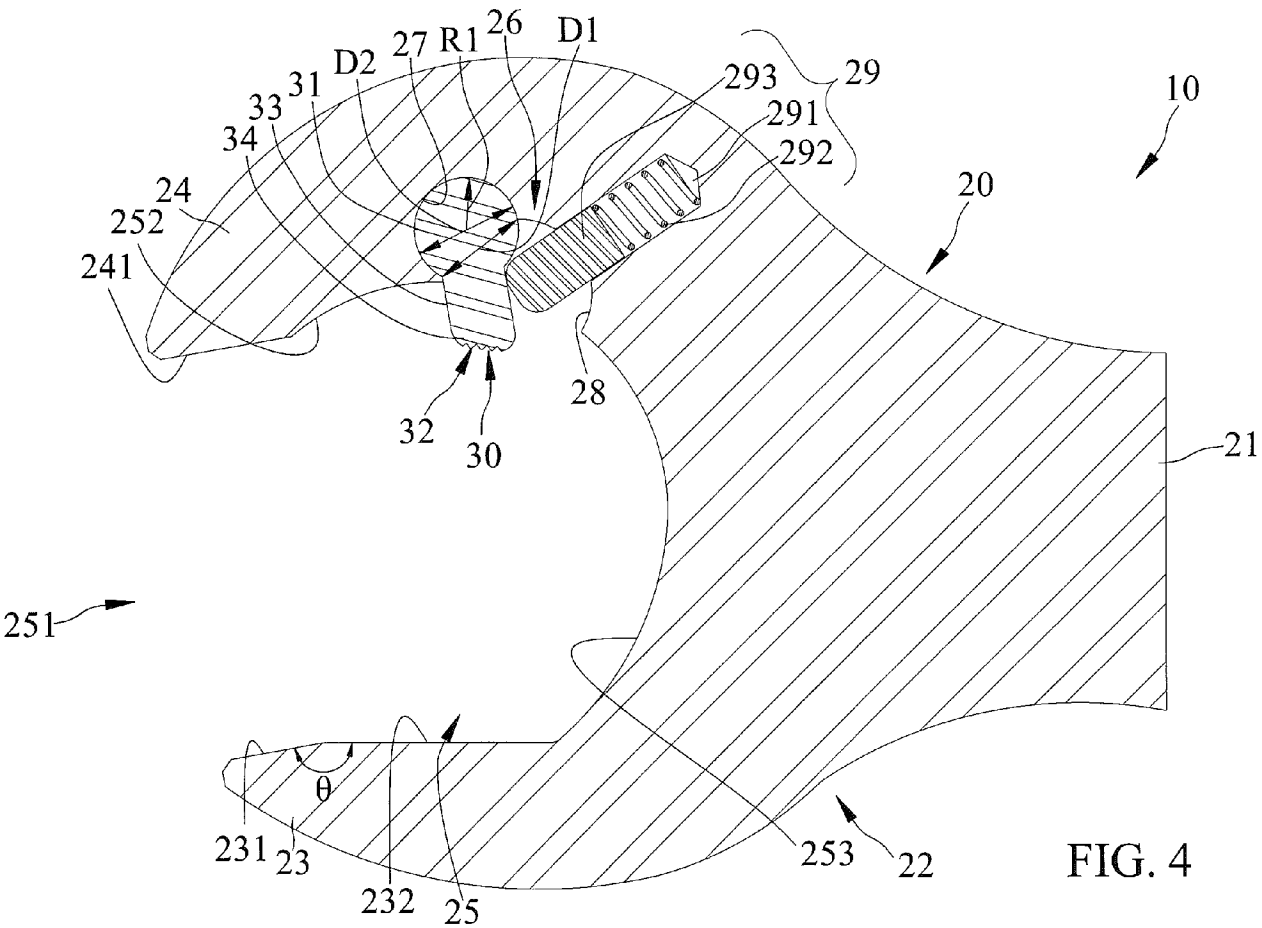
FIG. 4 is a cross-sectional view taken along line 4-4 of FIG. 1.
Figure 5:
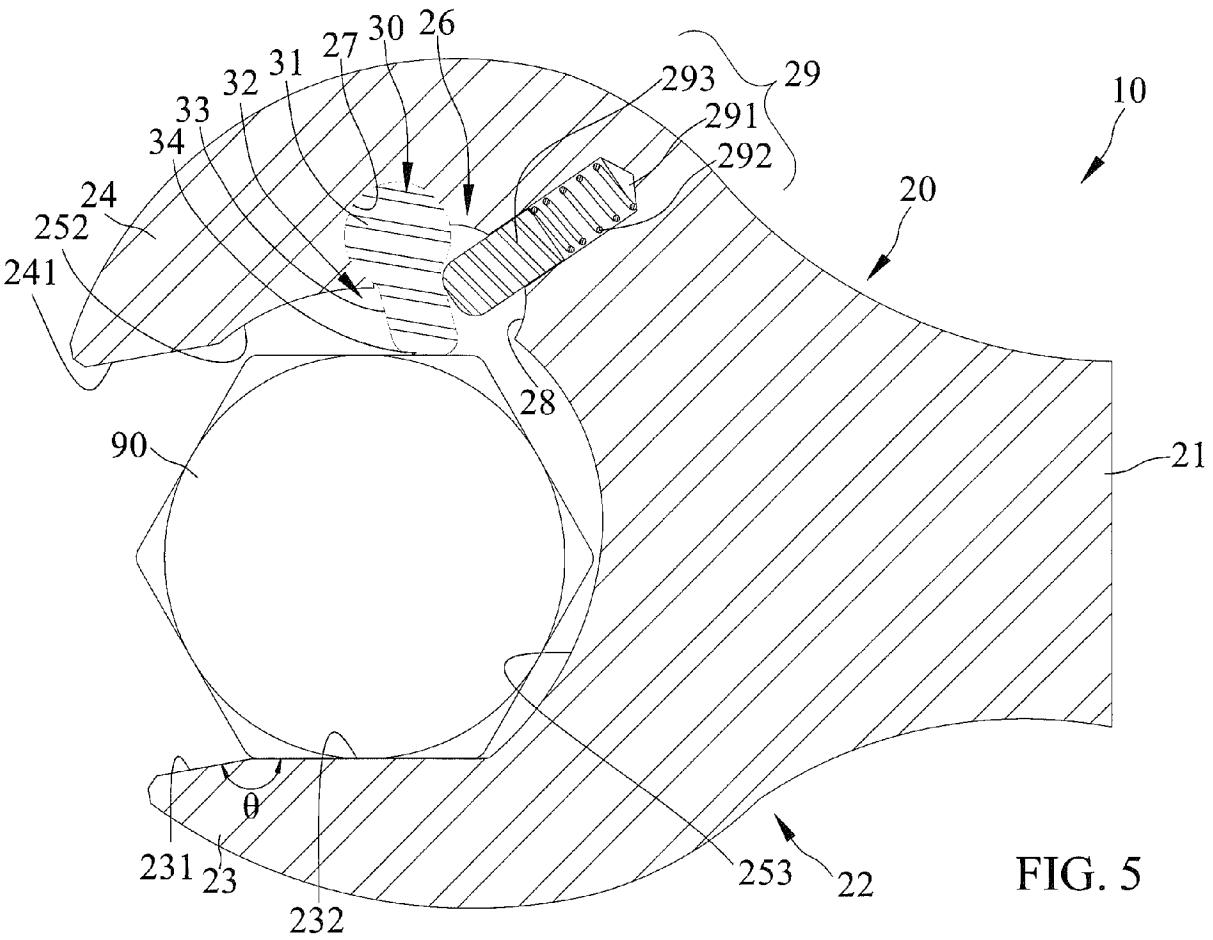
FIG. 5 is a continued view of FIG. 4, and shows an object in a position to be driven by the open-end wrench.
Figure 6:
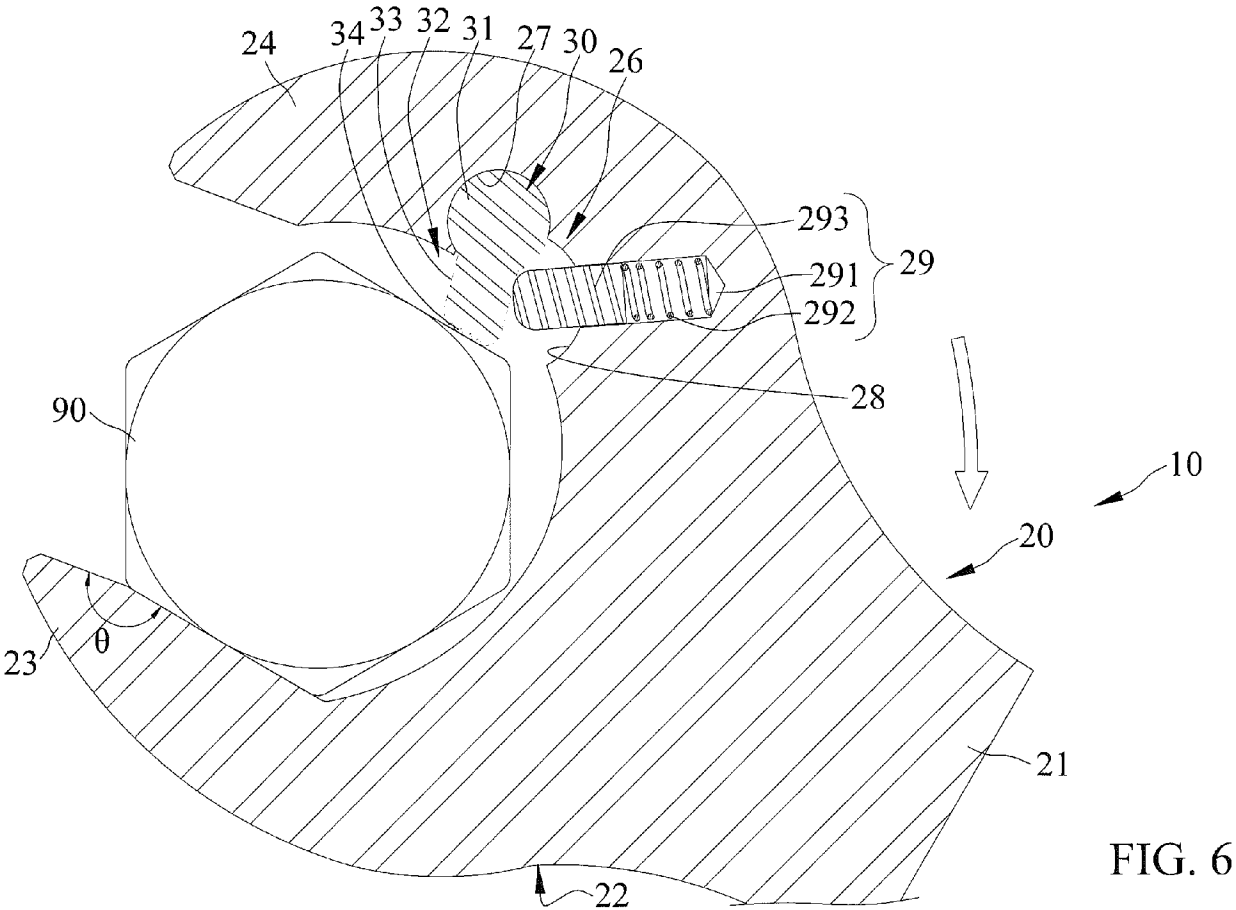
FIG. 6 is a continued view of FIG. 5, and shows the open-end wrench in a first operation direction and the object turned through an angle, with the arrow indicating the first operating direction.
Figure 7:
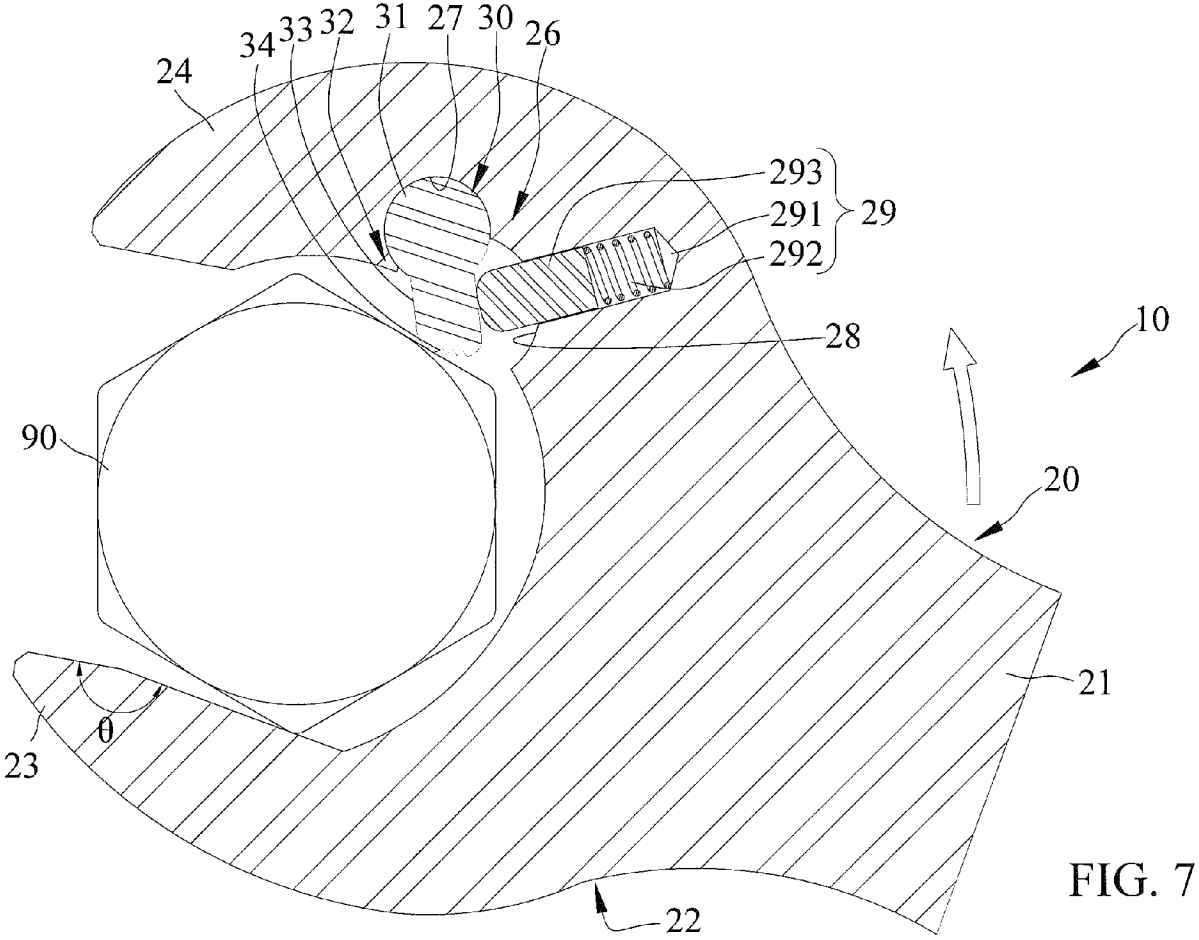
FIG. 7 is a continued view of FIG. 6, and shows the open-end wrench in a second operating direction and the object not turned by the open-end wrench, with the arrow indicating the second operating direction.
Figure 8:
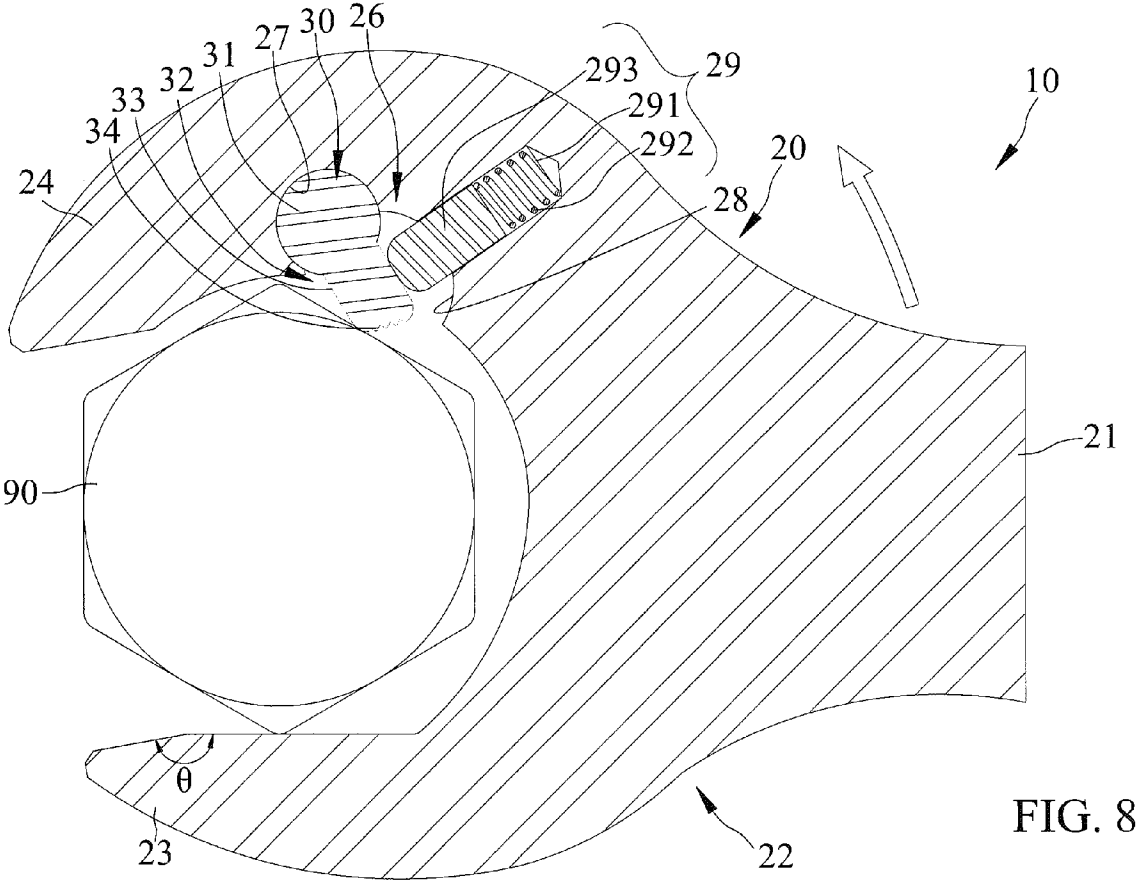
FIG. 8 is a continued view of FIG. 7, and shows the open-end wrench in the second operating direction and in a different relative position with respect to the object from FIG. 7.
Figure 9:
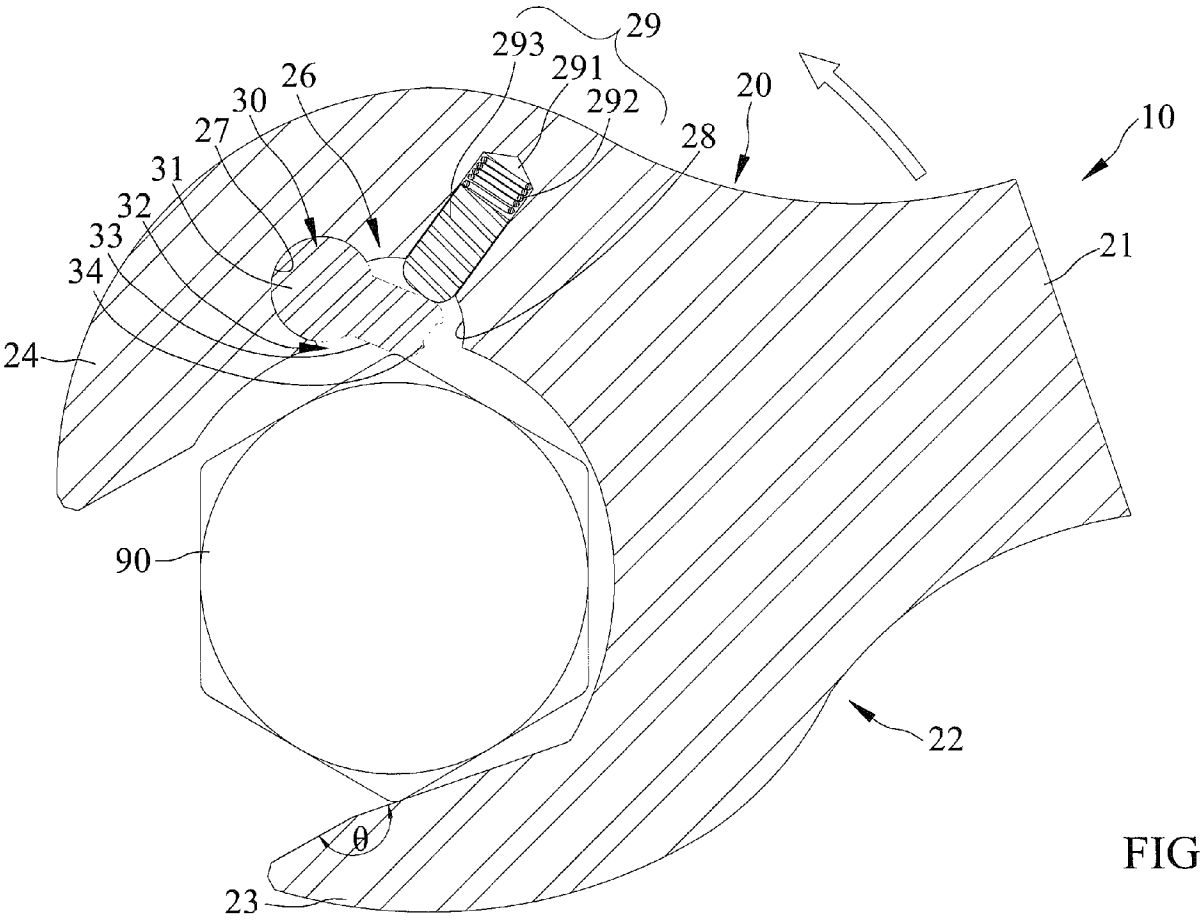
FIG. 9 is a continued view of FIG. 8, and shows the open-end wrench in the second operating direction and in a different relative position with respect to the object from FIG. 8.
Figure 10:
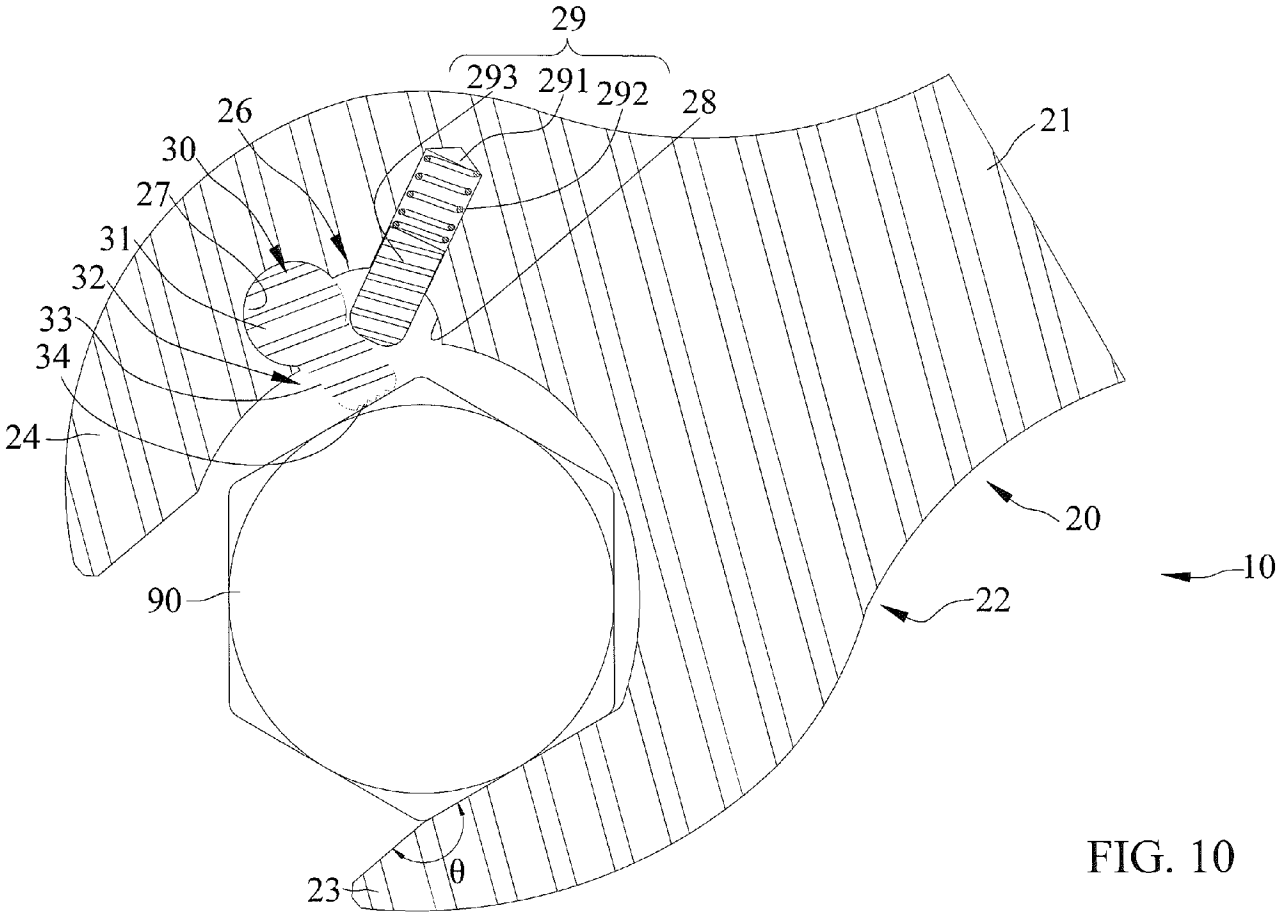
FIG. 10 is a continued view of FIG. 9, and shows the open-end wrench in the second operating direction and in a different relative position with respect to the object from FIG. 9.

FIGS. 1 through 10 show a simple open-end wrench 10 in accordance with a first embodiment of the present invention. The open-end wrench 10 has a body 20. The body 20 includes a handle section 21 and a driving head 22. The driving head 22 includes first and second jaws 23 and 24. An engaging area 25 delimits a space 251 for receiving an object 90 to be driven by the open-end wrench 10. The space 251 is delimited between the first and second jaws 23 and 24. One of the first and second jaws 23 and 24 defines first and second lateral sides 231 and 232 delimiting the space 251. The first and second lateral side 231 and 232 are adjacent to and angled with each other with an included angle θ less than 180 degrees. The other of the first and second jaws 23 and 24 defines a third lateral side 241 facing opposite and substantially parallel with the first lateral side 231 of the first jaw 23. First and second arcuate edges 252 and 253 also delimit the space 251. The first arcuate edge 252 is adjacent to the second lateral side 232. The second lateral side 232 and the first arcuate edge 252 are extended on two different sides of the second arcuate edge 253. A recessed section 26 includes first and second recesses 27 and 28 extended from the space 251. The first and second recesses 27 and 28 are adjacent to each other. The driving head 22 defines an upper side 221 and a bottom side 222 opposite the upper side 221, and the first and second recesses 27 and 28 are both extended through the upper and bottom sides 221 and 222. An open end of the first recess 27 to the space 251 has a gap 271 with a width defining a first distance D1.

A pawl 30 is pivotally embedded in the first recess 27. A biasing mechanism 29 is received in the second recess 28 and abutted against the pawl 30. The second recess 28 includes a cavity 291 extended therefrom. The biasing mechanism 29 includes a biasing member 292 and a pusher 293. The biasing member 292 has a first end restrained in the cavity 291 and a second end engaged with the pusher 293, and the pusher 293 is subject to a biasing force of the biasing member 292. The pusher 293 has an end engaged with the pawl 30. The biasing member 292 has a shape including a plurality of coils.

The pawl 30 has a first end thereof defining a joining end 31 abutted against a peripheral wall of the first recess 27 and a second end thereof defining an abutting end 32 interacting with the object 90 to be driven. The joining end 31 of the pawl 30 has a curved periphery abutted against and corresponding to the peripheral wall of the first recess 27. The joining end 31 of the pawl 30 has at least a half circumference abutted against the peripheral wall of the first recess 27. The first recess 27 has a diameter defining a second distance D2, with the diameter passing through a center that the pawl 30 pivots about. The second distance D2 is greater than the first distance D1. The peripheral wall of the first recess 27 includes two extensions 272 protruded therefrom, with one ridge extension 272 extended over a top edge 311 and the other extension 272 extended over a bottom edge 312 of the joining end 31 of the pawl 30 respectively to restrain the pawl 30.

The joining end 31 of the pawl 30 has a radius R1 with respect to a center of curvature thereof. The abutting end 32 of the pawl 30 has a distal end thereof defining a flat edge extending obliquely and including a plurality of teeth extended thereon interacting with the object 90 to be driven, and the serrated distal end enables a better frictional contact and prevents slippage between the abutting end 32 of the pawl 30 and the object 90. Additionally, it is contemplated that the distal end of the abutting end 32 of the pawl 30 define a curved or flat edge, with or without a plurality of teeth extended thereon, for interacting with the object 90 to be driven. The distal end of the abutting end 32 of the pawl 30, which defines a flat edge and without the plurality of teeth extended thereon, has a surface contact with the object 90 to be driven, with the flat edge engaging with and in surface conformity to a peripheral side of the object 90. Therefore, the abutting end 32 of the pawl 30 is prevented from slippage relative to the object 90 to be driven. The abutting end 32 of the pawl 30 includes first and second sections 33 and 34. The pawl 30 includes the abutting end 32 including the first section 33 extended from the joining end 31 and the second section 34 extended from the first section 33. The abutting end 32 of the pawl 30 includes the second section 34 having a periphery defining the distal end thereof for interacting with the object 90.

The joining end 31 and the abutting end 32 of the pawl 30 have the same height.

The pawl 30 includes the abutting end 32 disposed outside the second recess 28 and extended into the space 251. The pawl 30 is pivotal to a position with the abutting end 32 thereof disposed within the second recess 28. When the object 90 is turned with the open-end wrench 10, the pawl 30 includes the abutting end 32 against the object 90 and will not pivot. When the open-end wrench 10 turns relative to the object, the pawl 30 is in a reciprocal pivotal movement, and is pivotal into the second recess 28.

Figure 11:
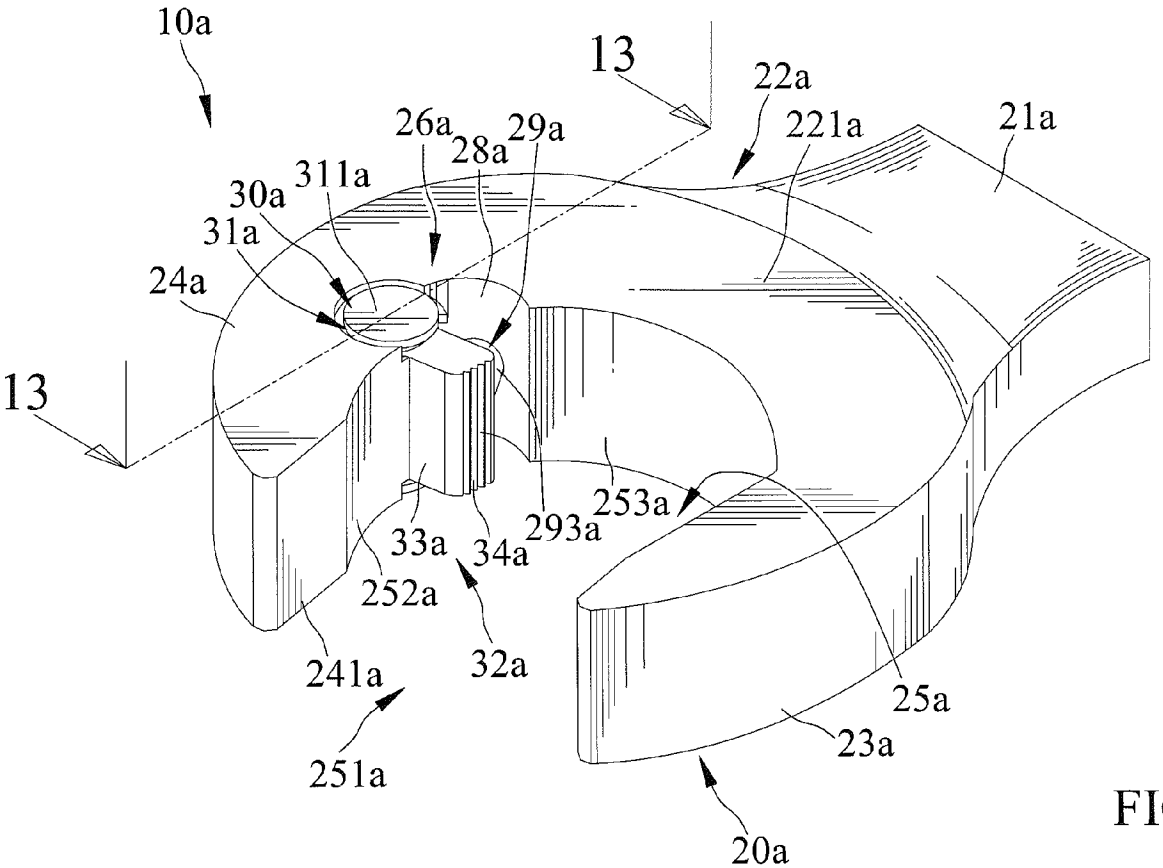
FIG. 11 is a perspective view of a driving head of a simple open-end wrench in accordance with a second embodiment of the present invention.
Figure 12:
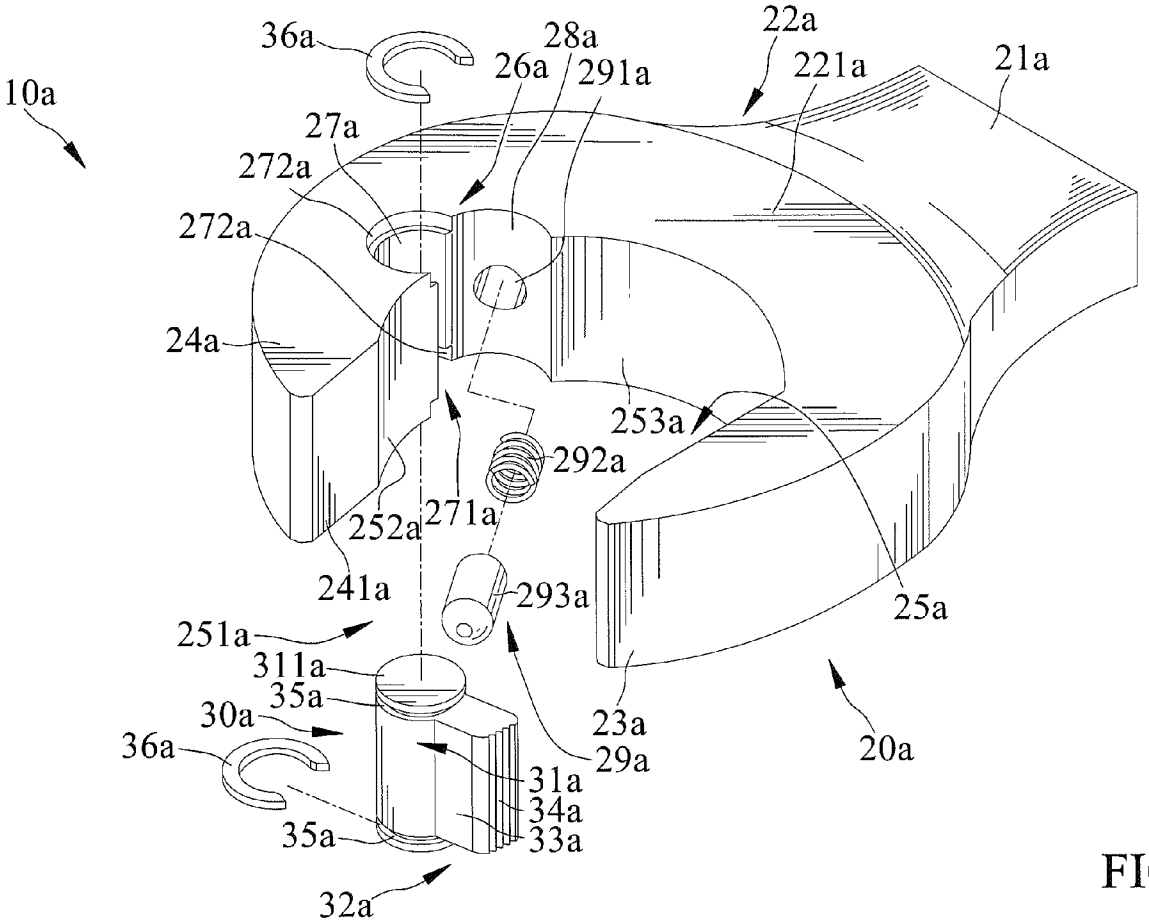
FIG. 12 is an exploded perspective view of FIG. 11.
Figure 13:
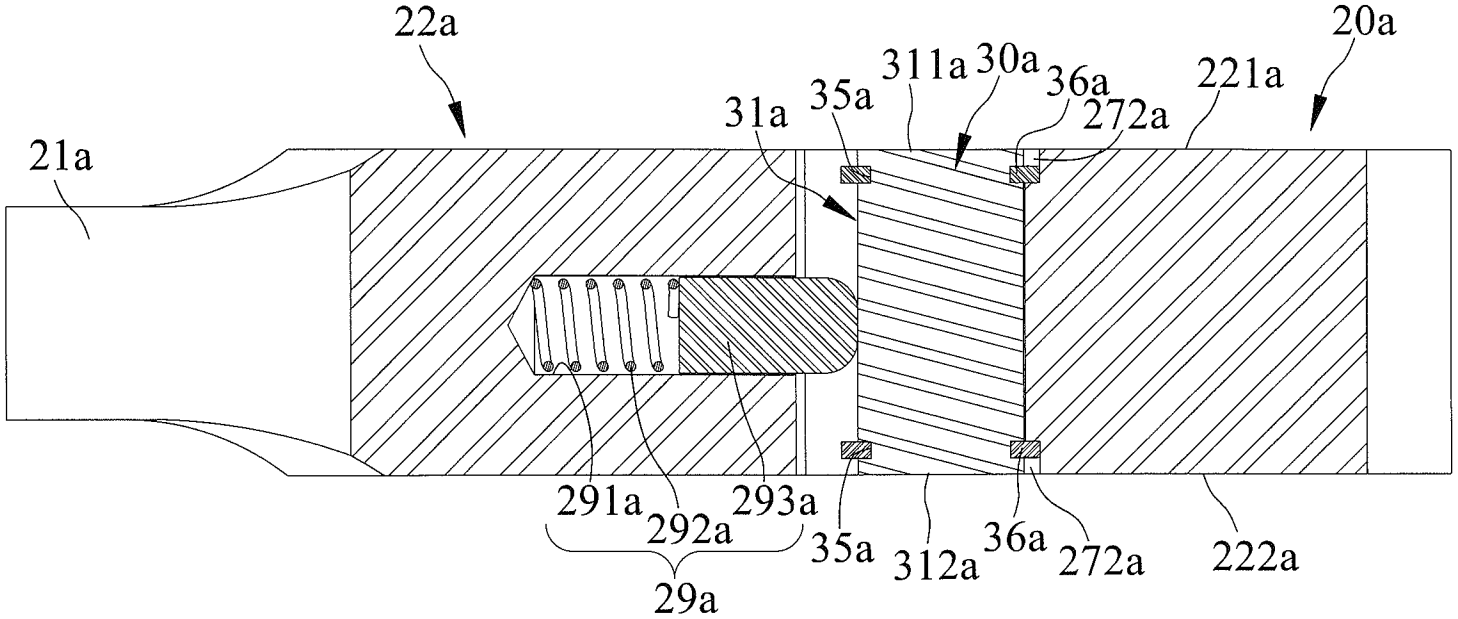
FIG. 13 is a cross-sectional view taken along line 13-13 of FIG. 11.

FIGS. 11 through 13 show a driving head of a simple open-end wrench 10*a* in accordance with a second embodiment of the present invention, and the same numbers are used to correlate similar components of the first embodiment, but bearing a letter a. The second embodiment is similar to the first embodiment except a driving head 22*a* replaces the head 22. The driving head 22*a* includes a recess 27*a*. A peripheral wall of the first recess 27*a* includes two extensions 272*a* inset therein. The two extensions 272*a* each include a retaining ring 36*a* received therein, and the retainer ring 36*a* is clipped on a joining end 31*a* of a pawl 30*a* to restrain the pawl 30*a*. The retainer ring 36*a* is extended into a groove 35*a* inset on an outer periphery of the joining end 31*a* of the pawl 30*a*.

Figure 14:
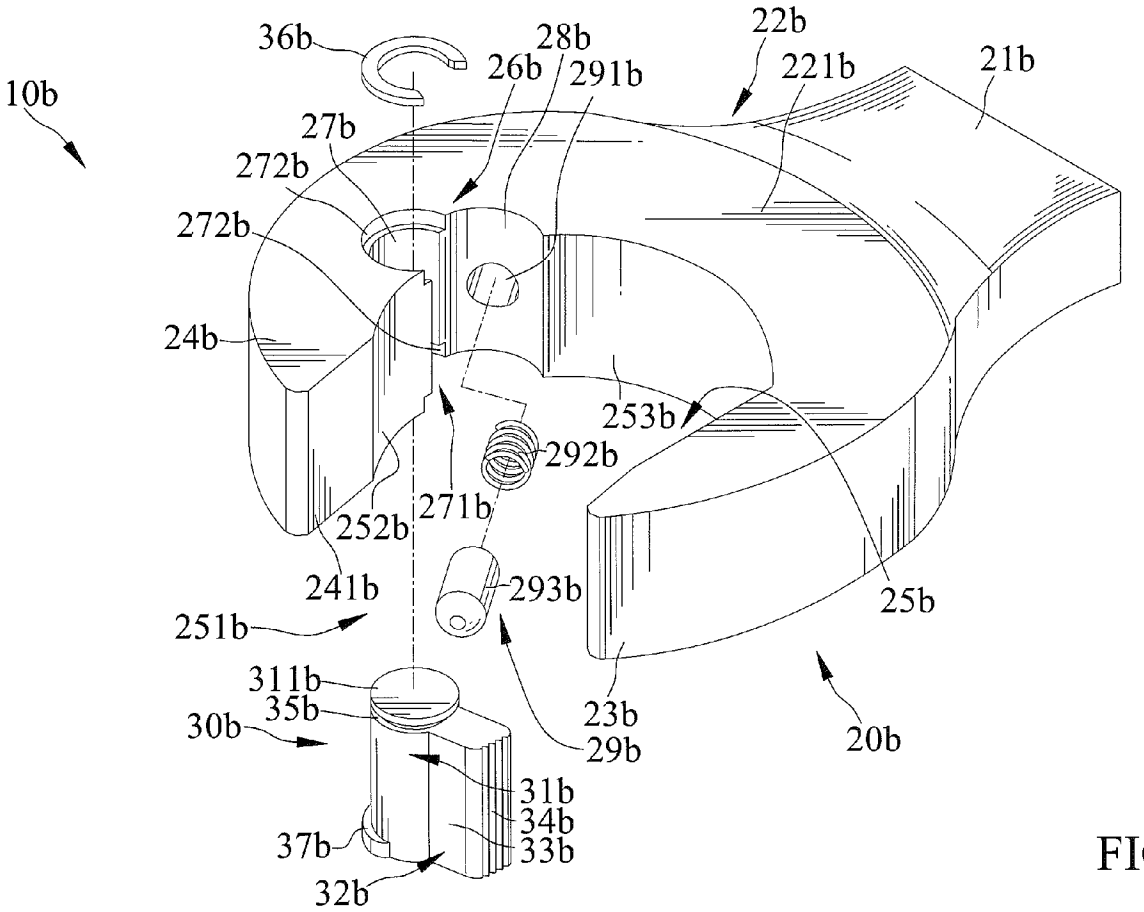
FIG. 14 is an exploded perspective of a driving head of a simple open-end wrench in accordance with a third embodiment of the present invention.
Figure 15:
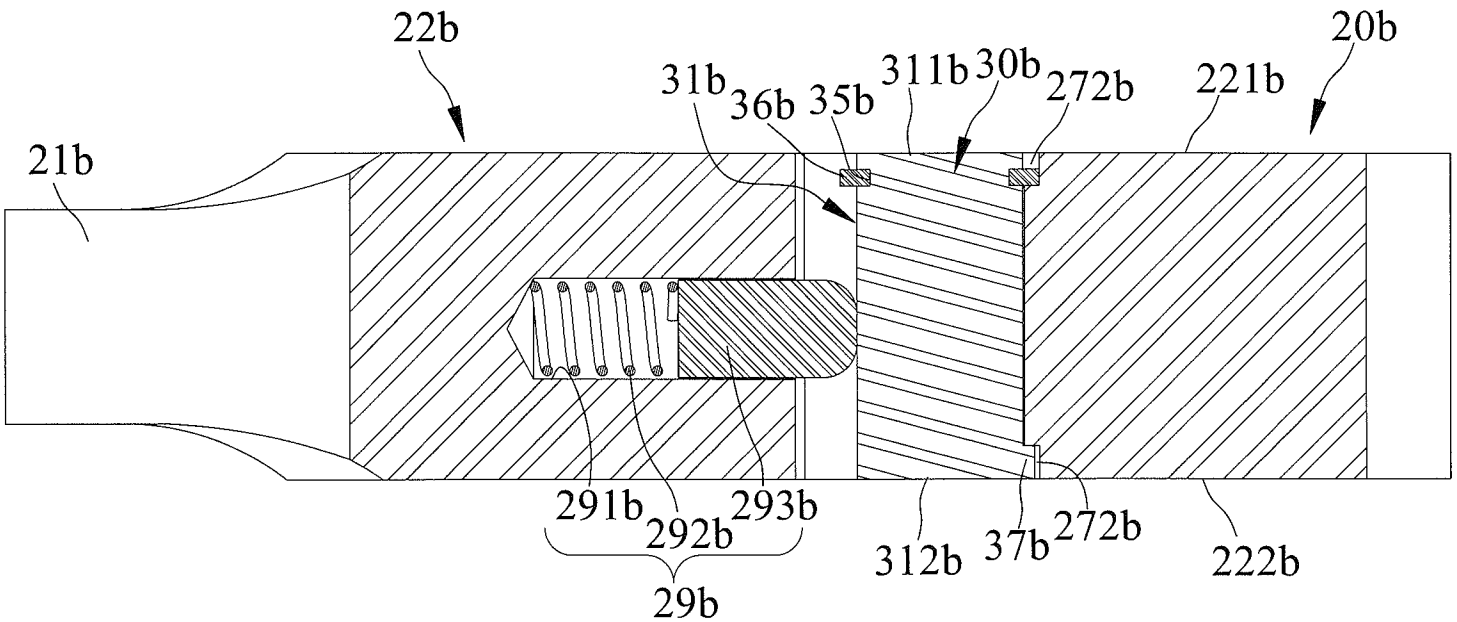
FIG. 15 is a cross-sectional view of FIG. 14.

FIGS. 14 through 15 show a driving head of a simple open-end wrench 10*b* in accordance with a third embodiment of the present invention, and the same numbers are used to correlate similar components of the first embodiment, but bearing a letter b. The third embodiment is similar to the first embodiment except a driving head 22*b* replaces the driving head 22. The head 22*b* includes a recess 27*b*. A peripheral wall of the first recess 27*b* includes two extensions 272*b* inset therein. One of the two extensions 272*b* includes a retaining ring 36*b* clipping on a joining end 31*b* of a pawl 30*b* received therein, and the pawl 30*b* includes an outer periphery thereof including a flange 37*b* extended thereon received in the other of the two extensions 272*b*. Therefore, the pawl 30*b* is restrained. The retainer ring 36*b* is extended into a groove 35*h* inset on the outer periphery of the joining end 31*b* of the pawl 30*b*.

Figure 16:
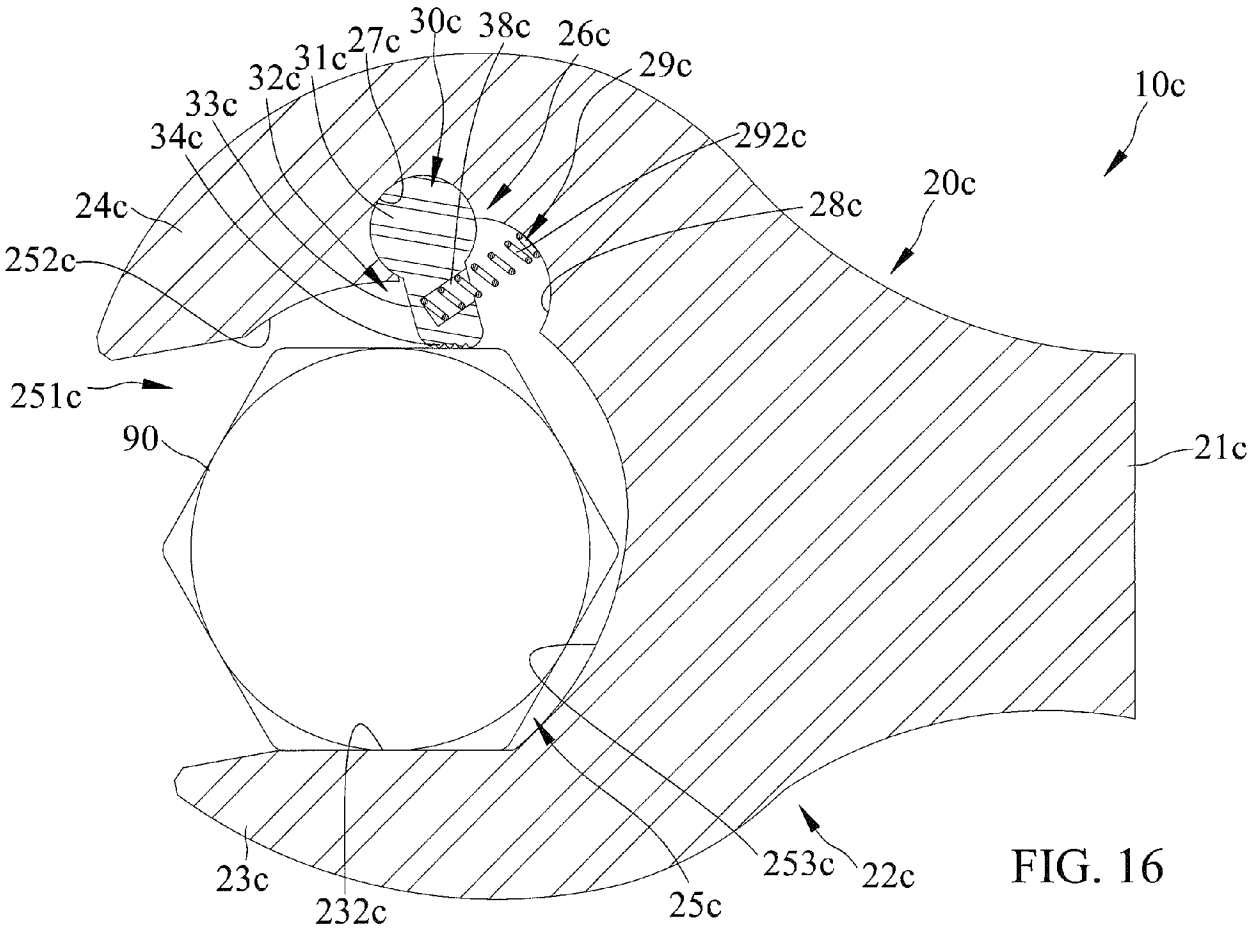
FIG. 16 is a cross-sectional view of a driving head of a simple open-end wrench in accordance with a fourth embodiment of the present invention, and shows an object in a position to be driven by the open-end wrench.
Figure 17:
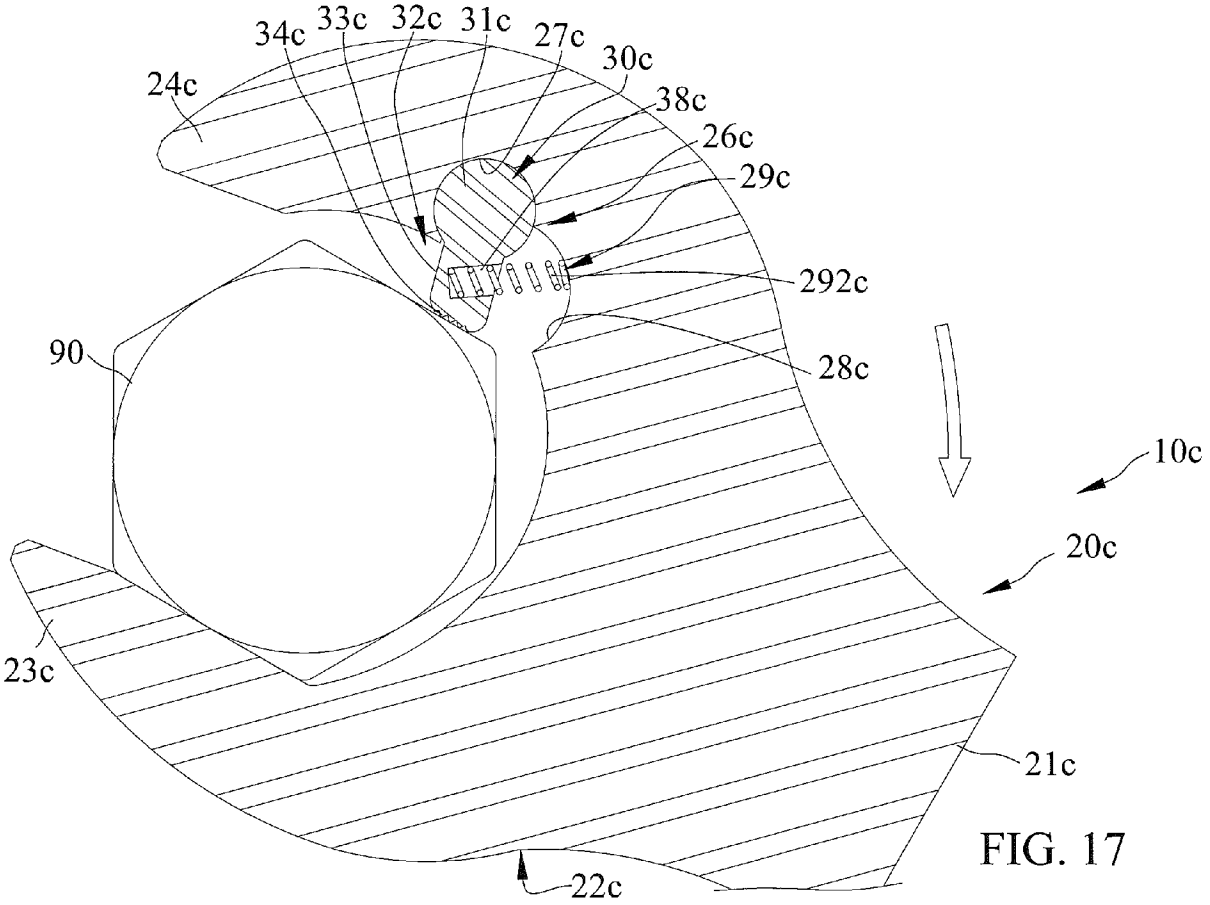
FIG. 17 is a continued view of FIG. 16, and shows the open-end wrench in a first operation direction and the object turned through an angle, with the arrow indicating the first operating direction.
Figure 18:
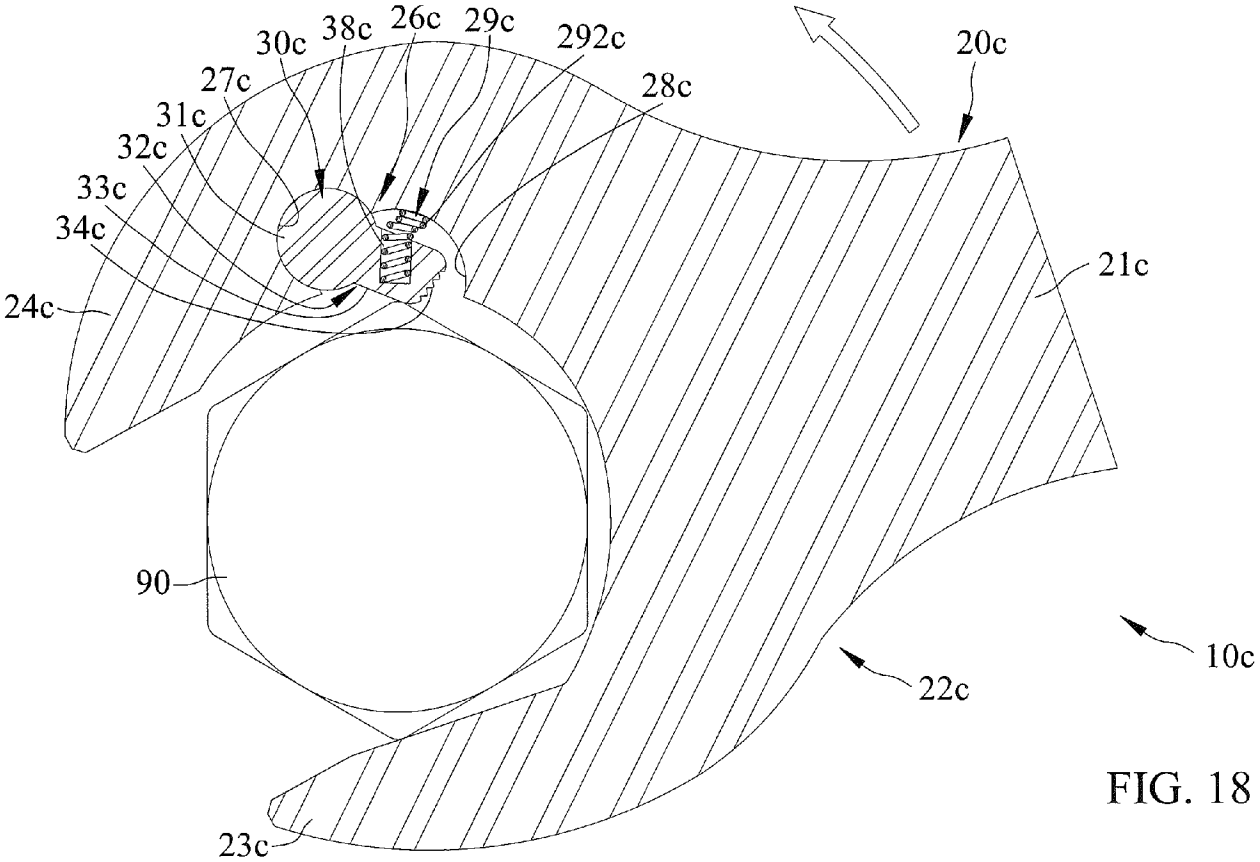
FIG. 18 is a continued view of FIG. 17, and shows the open-end wrench in a second operating direction and the object not turned by the open-end wrench, with the arrow indicating the second operating direction.

FIGS. 16 through 18 show a driving head of a simple open-end wrench 10*c* in accordance with a fourth embodiment of the present invention, and the same numbers are used to correlate similar components of the first embodiment, but bearing a letter c. The fourth embodiment is similar to the second embodiment except with a biasing mechanism 29*c* replacing the biasing mechanism 29*a*. The biasing mechanism 29*c* includes a biasing member 292*c*. The biasing member 292*c* has a first end restrained in a second recess 28*c* and a second end engaged with a pawl 30*c*. The pawl 30*c* includes a notch 38*c* inset therein receiving the second end of the biasing member 292*c*.

Figure 19:
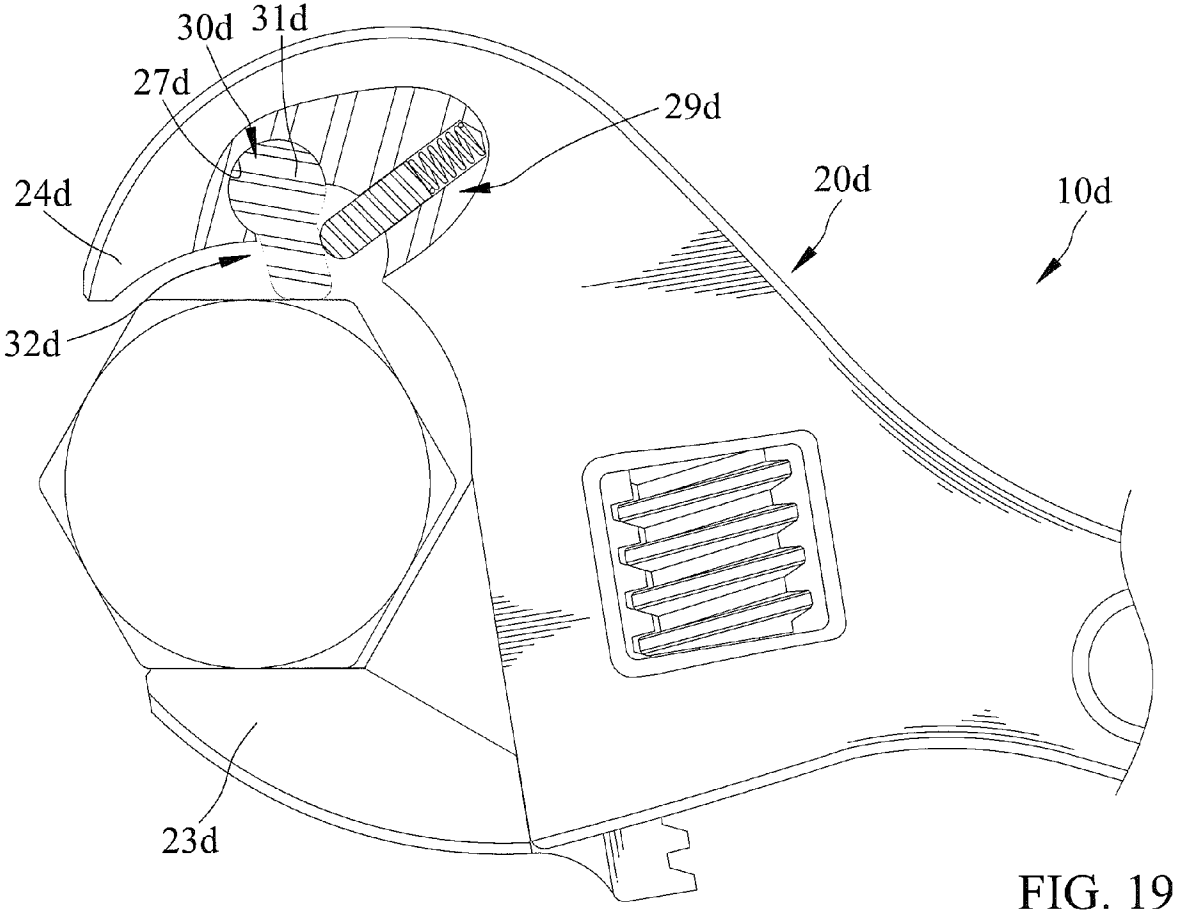
FIG. 19 is a side and partial cross-sectional view of a driving head of a simple open-end wrench in accordance with a fifth embodiment of the present invention, and shows an object in a position to be driven by the open-end wrench, with the open-end wrench including a ratchet mechanism similar to that in the first embodiment.
Figure 20:
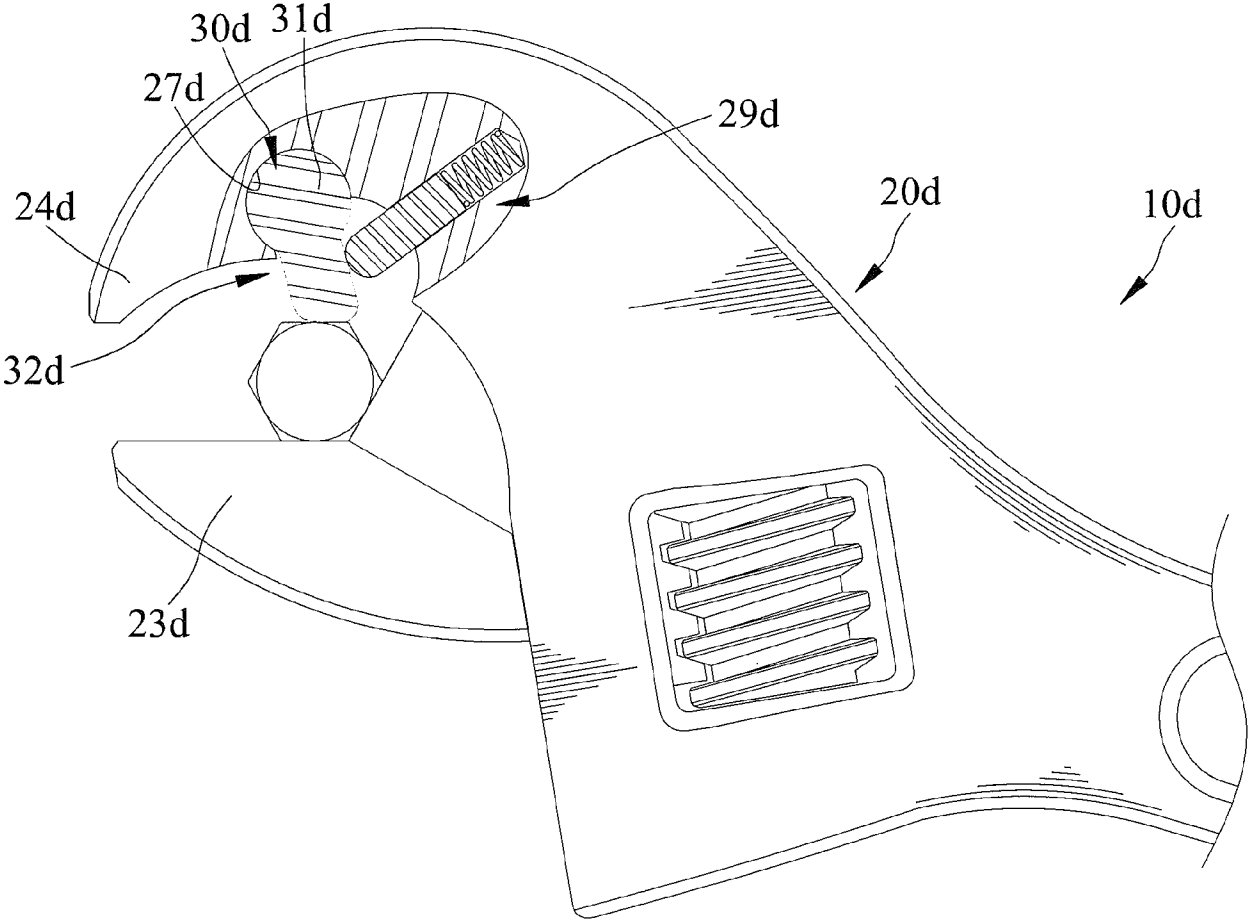
FIG. 20 shows the open-end wrench of FIG. 19 and a smaller object than that shown in FIG. 19 in a position to be driven by the open-end wrench.

FIGS. 19 and 20 show a driving head of a simple open-end a wrench 10*d* in accordance with a fifth embodiment of the present invention, and the same numbers are used to correlate similar components of the first embodiment, but bearing a letter d. The fifth embodiment is similar to the first embodiment, except it includes first and second jaws 23*d* and 24*d* having various relative positions.

Figure 21:
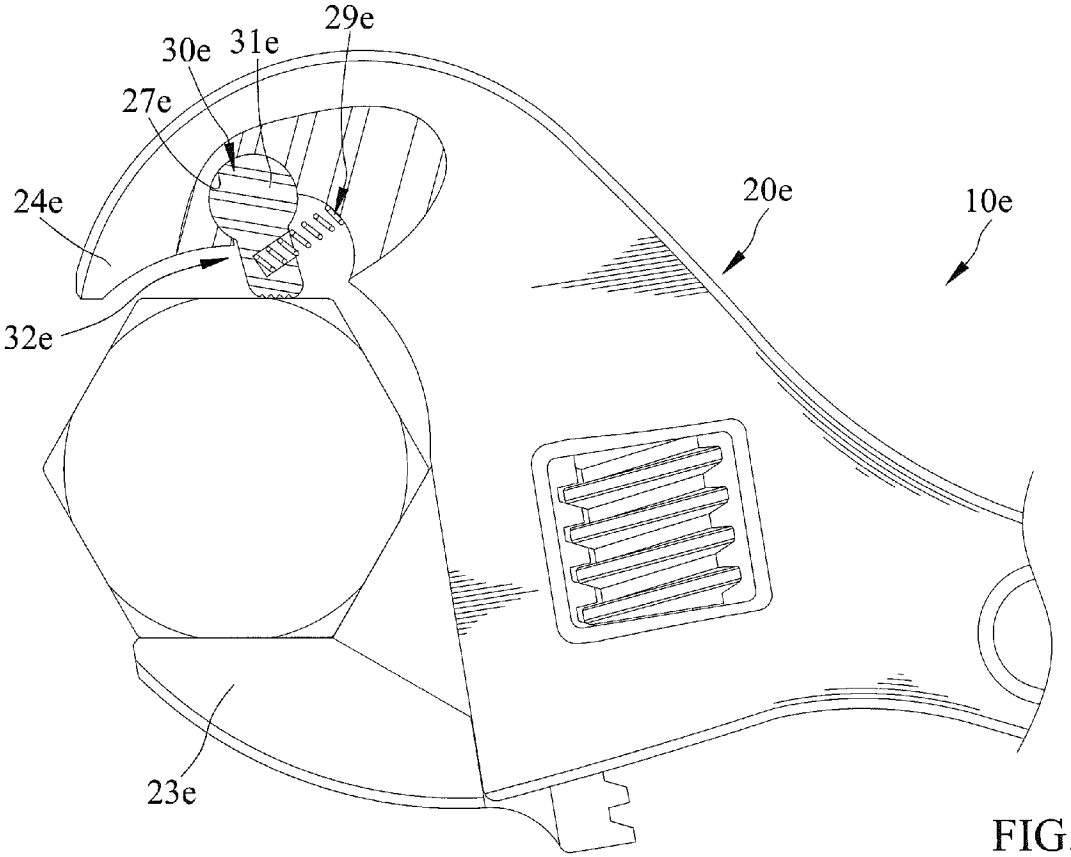
FIG. 21 is a side and partial cross-sectional view of a driving head of a simple open-end wrench in accordance with a sixth embodiment of the present invention, and shows an object in a position to be driven by the open-end wrench, with the open-end wrench including a ratchet mechanism similar to that in the fourth embodiment.

FIG. 21 shows a driving head of a simple open-end a wrench the in accordance with a sixth embodiment of the present invention, and the same numbers are used to correlate similar components of the first embodiment, but bearing a letter e. The sixth embodiment is similar to the fourth embodiment, except it includes first and second jaws 23*e* and 24*e* having various relative positions.

In view of the forgoing, the pawl 30, 30*a*, 30*b*, 30*c*, 30*d*, and 30*e* is pivotally retained in the recess 27, 27*a*, 27*b*, 27*c*, 27*d*, and 27*e* without any pivot inserting therethrough, and the joining end 31*a*, 31*b*, 31*c*, 31*d*, and 31*e* thereof are enlarged in size to achieve a greater surface contact with the peripheral wall of the recess 27, 27*a*, 27*b*, 27*c*, 27*d*, and 27*e*, as well as to withstand a larger shear force. Additionally, the pawl 30, 30*a*, 30*b*, 30*c*, 30*d*, and 30*e* is prevented from a concentrated shear force, as the joining end 31*a*, 31*b*, 31*c*, 31*d*, and 31*e* thereof and the peripheral wall of the recess 27 are both curved and correspond to each other.

While the specific embodiments have been illustrated and described, numerous modifications come to mind without significantly departing from the spirit of invention, and the scope of invention is only limited by the scope of the accompanying claims.

What is claimed is:

1. A simple open-end wrench comprising:

a driving head including first and second jaws and a space delimited therebetween for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl, wherein the pawl includes the abutting end disposed outside the second recess and extended into the space, wherein the pawl is pivotal to a position with the abutting end thereof disposed within the second recess, wherein the biasing mechanism includes a biasing member, wherein the biasing member has a first end restrained in the second recess and a second end engaged with the pawl, and wherein the pawl includes a notch inset therein receiving the second end of the biasing member.

2. The simple open-end wrench as claimed in claim 1, wherein the joining end and the abutting end of the pawl have a same height.

3. The simple open-end wrench as claimed in claim 1, wherein the joining end of the pawl has a curved periphery abutted against and corresponding to the peripheral wall of the first recess, and has a radius with respect to a center of curvature thereof, and wherein the abutting end of the pawl has a distal end thereof defining a flat edge for interacting with the object to be driven, with the flat edge engaging with and in surface conformity to a peripheral side of the object.

4. The simple open-end wrench as claimed in claim 3, wherein the flat edge of the distal end of the abutting end of the pawl includes a plurality of teeth extended thereon for interacting with the object to be driven.

5. A simple open-end wrench comprising:

a driving head including first and second jaws and a space delimited therebetween for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl, wherein the pawl includes the abutting end disposed outside the second recess and extended into the space, wherein the pawl is pivotal to a position with the abutting end thereof disposed within the second recess, wherein an open end of the first recess to the space has a gap with a width defining a first distance, wherein the first recess has a diameter defining a second distance, with the diameter passing through a center that the pawl pivots about, wherein the second distance is greater than the first distance, wherein the joining end of the pawl has at least a half circumference abutted against the peripheral wall of the first recess, and wherein the peripheral wall of the first recess includes two extensions protruded therefrom, with one extension extended over a top edge and another extension extended over a bottom edge of the joining end of the pawl respectively.

6. A simple open-end wrench comprising:

a driving head including first and second jaws and a space delimited therebetween for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl, wherein the pawl includes the abutting end disposed outside the second recess and extended into the space, wherein the pawl is pivotal to a position with the abutting end thereof disposed within the second recess, wherein an open end of the first recess to the space has a gap with a width defining a first distance, wherein the first recess has a diameter defining a second distance, with the diameter passing through a center that the pawl pivots about, wherein the second distance is greater than the first distance, wherein the joining end of the pawl has at least a half circumference abutted against the peripheral wall of the first recess, wherein the peripheral wall of the first recess includes two extensions inset therein, wherein the two extensions each includes a retaining ring received therein, and wherein the retainer ring is clipped on the joining end of the pawl.

7. A simple open-end wrench comprising:

a driving head including first and second jaws and a space delimited therebetween for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl, wherein the pawl includes the abutting end disposed outside the second recess and extended into the space, wherein the pawl is pivotal to a position with the abutting end thereof disposed within the second recess, wherein an open end of the first recess to the space has a gap with a width defining a first distance, wherein the first recess has a diameter defining a second distance, with the diameter passing through a center that the pawl pivots about, wherein the second distance is greater than the first distance, wherein the joining end of the pawl has at least a half circumference abutted against the peripheral wall of the first recess, wherein the peripheral wall of the first recess includes two extensions inset therein, wherein one of the two extensions includes a retaining ring clipping on the joining end of the pawl received therein, wherein the pawl includes an outer periphery thereof including a flange extended thereon, and wherein the flange is received in another of the two extensions.

8. A simple open-end wrench comprising:

a driving head including first and second jaws and a space delimited therebetween for receiving an object to be driven by the open-end wrench, first and second recesses extended from the space, a pawl pivotally embedded in the first recess and having a first end thereof defining a joining end abutted against a peripheral wall of the first recess and a second end thereof defining an abutting end interacting with the object to be driven, and a biasing mechanism received in the second recess and abutted against the pawl, wherein the pawl includes the abutting end disposed outside the second recess and extended into the space, wherein the pawl is pivotal to a position with the abutting end thereof disposed within the second recess, and wherein the first and second jaws have various relative positions.

9. The simple open-end wrench as claimed in claim 8, wherein the second recess includes a cavity extended therefrom, wherein the biasing mechanism includes a biasing member and a pusher, wherein the biasing member has a first end restrained in the cavity and a second end engaged with the pusher, wherein the pusher is subject to a biasing force of the biasing member, and wherein the pusher has an end engaged with the pawl.

10. The simple open-end wrench as claimed in claim 9, wherein the joining end and the abutting end of the pawl have a same height.

11. The simple open-end wrench as claimed in claim 9, wherein the joining end of the pawl has a curved periphery abutted against and corresponding to the peripheral wall of the first recess, and has a radius with respect to a center of curvature thereof, and wherein the abutting end of the pawl has a distal end thereof defining a flat edge for interacting with the object to be driven, with the flat edge engaging with and in surface conformity to a peripheral side of the object.

12. The simple open-end wrench as claimed in claim 11, wherein the flat edge of the distal end of the abutting end of the pawl includes a plurality of teeth extended thereon for interacting with the object to be driven.

13. The simple open-end wrench as claimed in claim 8, wherein the biasing mechanism includes a biasing member, wherein the biasing member has a first end restrained in the second recess and a second end engaged with the pawl.

14. The simple open-end wrench as claimed in claim 8, wherein an open end of the first recess to the space has a gap with a width defining a first distance, wherein the first recess has a diameter defining a second distance, with the diameter passing through a center that the pawl pivots about, wherein the second distance is greater than the first distance, and wherein the joining end of the pawl has at least a half circumference abutted against the peripheral wall of the first recess.

15. The simple open-end wrench as claimed in claim 8, wherein the joining end of the pawl has a curved periphery abutted against and corresponding to the peripheral wall of the first recess, and has a radius with respect to a center of curvature thereof, and wherein the abutting end of the pawl has a distal end thereof defining a flat edge for interacting with the object to be driven, with the flat edge engaging with and in surface conformity to a peripheral side of the object.

16. The simple open-end wrench as claimed in claim 15, wherein the abutting end of the pawl has a periphery defining the distal end thereof for interacting with the object to be driven, with the periphery defining an edge extending obliquely.

17. The simple open-end wrench as claimed in claim 16, wherein the first and second jaws have various relative positions.

18. The simple open-end wrench as claimed in claim 8, wherein the flat edge of the distal end of the abutting end of the pawl includes a plurality of teeth extended thereon for interacting with the object to be driven.

19. The simple open-end wrench as claimed in claim 8, wherein the joining end and the abutting end of the pawl have a same height.

* * * * *